United States Patent [19]

Ehmig et al.

[11] Patent Number: 4,941,391

[45] Date of Patent: Jul. 17, 1990

[54] DRIVING PISTON BRAKING MEANS FOR EXPLOSIVE POWDER ACTUATED SETTING DEVICE

[75] Inventors: Gerhard Ehmig, Rankweil; Peter Jochum, Meiningen, both of Austria; Erich Maurer, Mauren, Liechtenstein

[73] Assignee: Hilti Aktiengesellschaft, Fürstentum, Liechtenstein

[21] Appl. No.: 365,222

[22] Filed: Jun. 12, 1989

[30] Foreign Application Priority Data

Jun. 10, 1988 [DE] Fed. Rep. of Germany ..... 3819813

[51] Int. Cl.[5] ..... B25C 1/14

[52] U.S. Cl. ..... 89/1.14; 227/10

[58] Field of Search ..... 89/1.14; 42/1.12; 227/9, 10, 11

[56] References Cited

U.S. PATENT DOCUMENTS

| | | | |
|---|---|---|---|
| 3,115,636 | 12/1963 | Elliott | 227/10 |
| 3,915,242 | 10/1975 | Bell | 173/134 |
| 4,064,783 | 12/1977 | Ess | 411/434 |
| 4,358,041 | 11/1982 | Ollivier | 227/10 |

FOREIGN PATENT DOCUMENTS

| | | | |
|---|---|---|---|
| 673276 | 10/1963 | Canada | 227/10 |
| 1100466 | 1/1968 | United Kingdom | 89/1.14 |

*Primary Examiner*—Charles T. Jordan
*Assistant Examiner*—Rochelle Lieberman
*Attorney, Agent, or Firm*—Toren, McGeady & Associates

[57] ABSTRACT

In an explosive powder actuated setting device, a driving piston (8) is displaceable between a ready-to-fire position and a fired position within a barrel (12) formed by a piston guide (5). When the piston is driven from the ready-to-fire position into the fired position, it is held by braking balls (17) supported in recesses (16) in the piston guide. As it moves into the fired position, the piston moves the braking balls into the range of a spring (18) which biases the balls inwardly against the shank (11) of the piston (8). When the piston is returned into the ready-to-fire position, the balls move out of the range of the spring releasing the biasing force acting on the piston shank via the balls.

7 Claims, 2 Drawing Sheets

DRIVING PISTON BRAKING MEANS FOR EXPLOSIVE POWDER ACTUATED SETTING DEVICE

BACKGROUND OF THE INVENTION

The present invention is directed to an explosive powder actuated setting device with a driving piston axially movably displaceable within a barrel in a piston guide. The piston guide has a recess open radially inwardly toward the piston. A braking ball is located within the recess in contact with the piston and a spring is located in the recess in contact with the braking ball.

In known explosive powder actuated setting devices, the explosive force is transmitted to a fastening element by a driving piston. The driving piston, supported in a piston guide, is driven through a barrel in the guide from a ready-to-fire position into a fired position. After the setting process is completed, the driving piston must be returned to the ready-to-fire position. Holding means insure that the driving piston is retained in the ready-to-fire position until the holding force is exceeded by the explosive force.

A setting device is disclosed in DE-PS No. 1 058 950 where the holding means is a spring-loaded braking ball constantly pressed against a shank of the driving piston. In the ready-to-fire position of the driving piston, the braking ball engages in an annular groove in the piston shank.

One disadvantage of such known holding means is that the holding force continues to act as the driving piston is returned into the ready-to-fire position and, as a result, interferes with the return of the piston.

SUMMARY OF THE INVENTION

Therefore, the primary object of the present invention is to provide an explosive powder actuated setting device in which the driving piston is returned into the ready-to-fire position without any braking action.

In accordance with the present invention, a recess is provided in the piston guide having an axial dimension exceeding the diameter of the braking ball. Further, the spring is located in the recess whereby, as the piston is driven by the explosive force, the spring biases the braking ball against the piston due to a tensioning of the spring. The piston moves the braking ball in the axial direction against an end surface in the recess closer to the leading end of the device.

In the ready-to-fire position, the braking ball contacts the surface of the shank of the driving piston as it is held by the spring at an end surface remote from the leading end of the device. When the driving piston is driven by the explosive force, it carries the braking ball along with it within the recess at the outset of the piston displacement. As the braking ball moves in the driving direction, the spring is tensioned and the ball contacts the end surface of the recess closer to the leading end. In the fired position, the braking ball is biased radially inwardly against the shank of the driving piston by the spring providing a braking force on the piston. The braking force can be released by a slight displacement of the driving piston toward the ready-to-fire position with the braking ball moving opposite to the driving direction and the spring being relaxed. As a result, a force acting opposite to the driving direction is transmitted to the driving piston by the braking ball. After the spring is relaxed, it no longer presses the braking ball radially inwardly against the shank of the driving piston.

Preferably, the axial dimension of the recess is in the range of 1.2 to 2 times the diameter of the braking ball. With such a dimensional range, it is assured that the functional positions of the braking ball are reached after a short axial movement of the driving piston assuring rapid control of the braking action.

Advantageously, the spring affords a biasing force acting radially inwardly against the driving piston. Further, the spring has a support surface in contact with the braking ball in the ready-to-fire position inclined at an acute angle relative to the piston axis and located on the side of the spring more remote from the leading end of the device. This support surface transmits the radial spring force of the spring to the braking ball in one component acting opposite to the driving direction and another component acting radially toward the driving piston. The acute angle of the support surface is preferably in the range of 3° to 9°.

In a preferred embodiment, the spring is in the form of a split spring ring with a radially inner surface of the ring forming a support surface contacted by the braking ball in the ready-to-fire position. This configuration of the spring has proved to be a simple construction and is not susceptible to damage. When two or more braking balls are used spaced circumferentially about the driving piston, there is the advantage that the spring ring acts on all of the braking balls simultaneously with the same biasing force.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figures 1, 2:
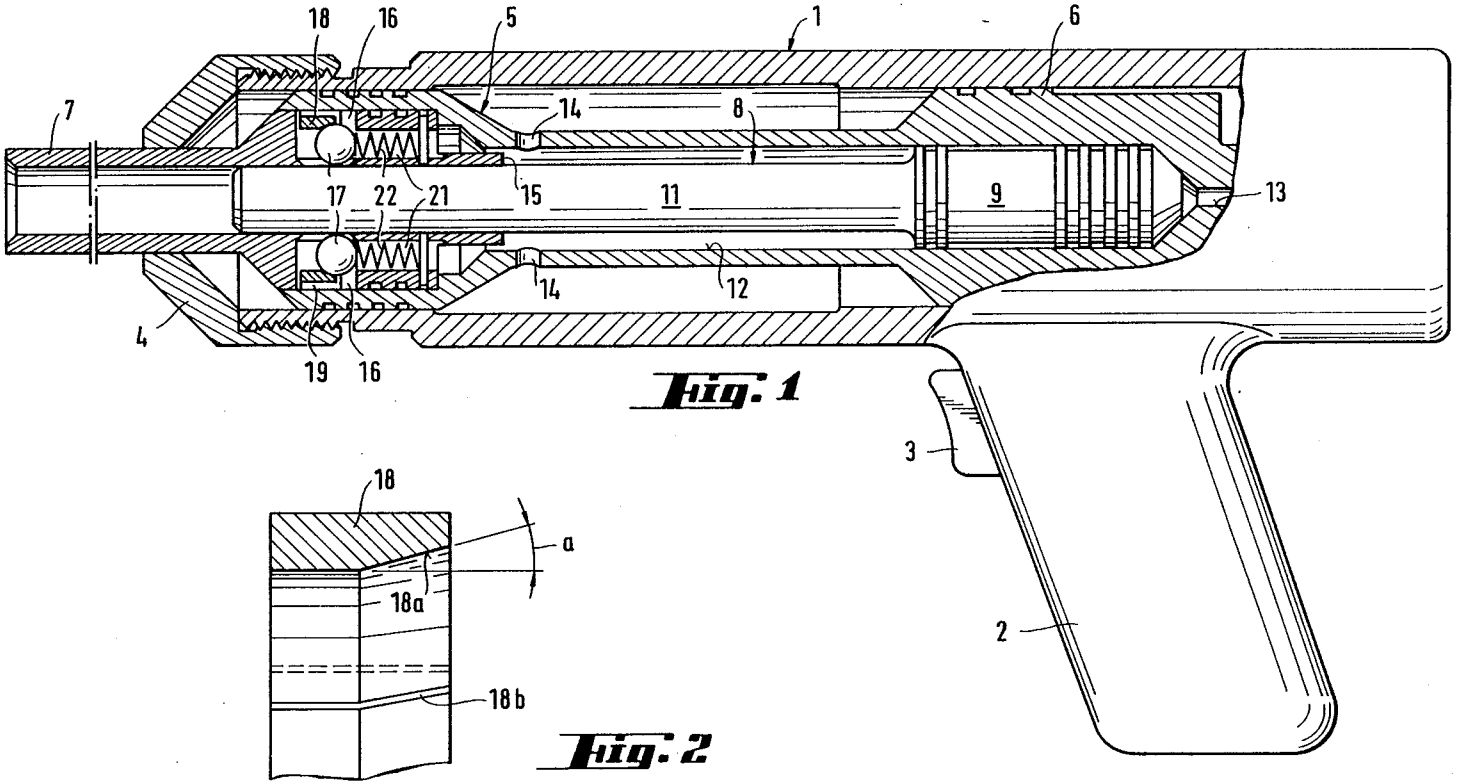
FIG. 1 is a side elevational view of an explosive powder actuated setting device in its ready-to-fire position and shown partially in axial section.
FIG. 2 is a partial sectional view of a spring ring used in the device in FIG. 1 and displaced on an enlarged scale.

In FIG. 1, an explosive powder actuated setting device is shown in the ready-to-fire position with the left end of the device and of its various parts being the leading end and the right end being the trailing end. The setting device includes a housing 1, having a handle 2, adjacent its trailing end with a trigger 3 in the handle. The open leading end of the housing 1 is closed by a stop bushing 4 threaded onto the housing. A two-part piston guide 5 is displaceably supported within the housing 1. Piston guide 5 extends in the axial or driving direction and is made up of a trailing part 6 located within the housing and a leading part 7 projecting axially from the leading end of the housing 1 and passing through the bushing 4. The piston guide 5 forms a barrel 12 containing an axially elongated driving piston 8 with a head 9 at its trailing end, guided within the trailing part 6, and an axially extending shank 11 guided in the leading part 7. At its trailing end, the trailing part 6 has a passageway 13 for conducting explosive gases of an explosive powder charge into the trailing end of the barrel 12. At its leading end, trailing part 6 has openings 14 through which air, located in front of the head, can flow when the driving piston 8 is driven toward the leading end of the device. At its leading end, the trailing part 6 widens outwardly and concentrically overlaps the trailing region of the leading part 7. Leading part 7 extends through the stop bushing 4 and forms a muzzle at its leading end. A rear or trailing tubular section of the leading part 7 extends into the barrel 12 defined by the trailing part 6 and forms a stop 15 limiting the path of movement of the piston 8 in the driving direction.

Figure 3:
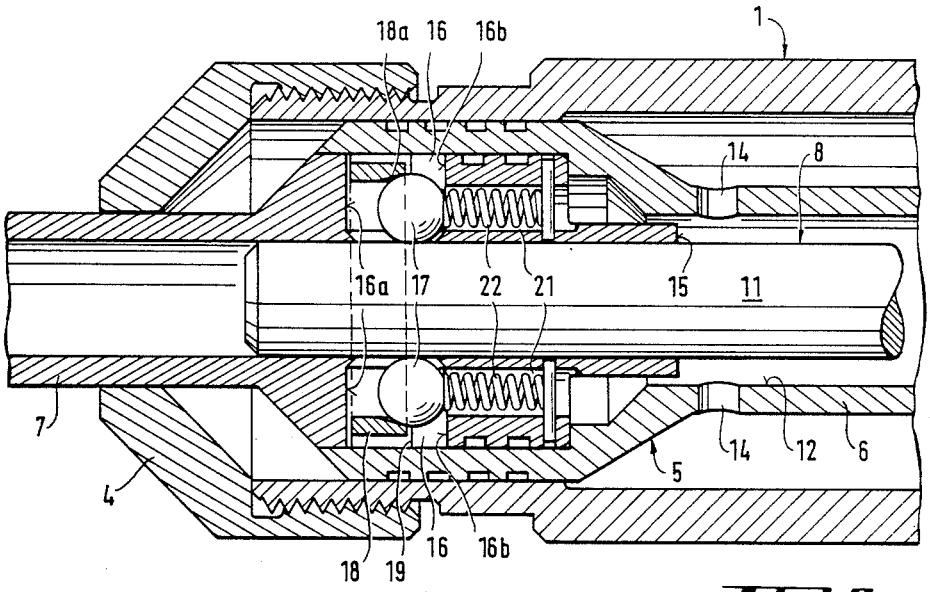
FIG. 3 is a partial view of the setting device in FIG. 1 shown in section and on an enlarged scale.

In the region of the widened leading end of the trailing part 6, the leading part 7 has recesses 16 located diametrically opposite one another and opening radially inwardly and outwardly in the leading part which is also radially widened in this region. As shown in FIGS. 1 and 3, a braking ball 17 is supported in each recess 16 and the recess has a dimension in the axial direction of the device corresponding to 1.5 times the diameter of the braking balls 17. The radially inner surfaces of the recesses 16 are in converging relation to prevent the braking balls from moving inwardly out of the recesses. The braking balls 17 bear radially inwardly against the surface of the shank 11 of the driving piston 8. Radially outwardly, the braking balls are supported by an annular spring 18 in the form of a spring ring. As can be seen in the drawing, the braking balls extend into the spring 18 and contact a circumferentially extending support surface 18*a* in the inner surface of the spring. Support surface 18*a* is inclined at an acute angle relative to the piston axis defining an opening directed opposite to the driving direction. The support surface 18*a* is shown on an enlarged scale in FIG. 2. At the leading end of the support surface 18*a*, the ring has a cylindrical inner surface extending for the remainder of its length in the axial or driving direction. As shown in FIG. 2, the spring 18 is a split ring with an axially extending slot 18*b* enabling the expansion and tensioning of the ring. As shown in FIGS. 1 and 3, an annular groove 19 is formed in the leading part 7 for receiving the spring ring 18. About the radially outer surface of the ring, the groove 19 affords radially outward movement of the spring ring. The inner surface of the trailing part 6 limits the radially outward movement of the spring 18 when the piston 8 is driven into the fired position.

Further, axially extending holes 21 are formed in the leading part 7 with the holes being open in the driving direction and in alignment with the braking balls 17. Each of the balls 21 has a cylindrical spring 22 biasing the braking balls 17 against the support surface 18*a* in the spring.

Figure 4:
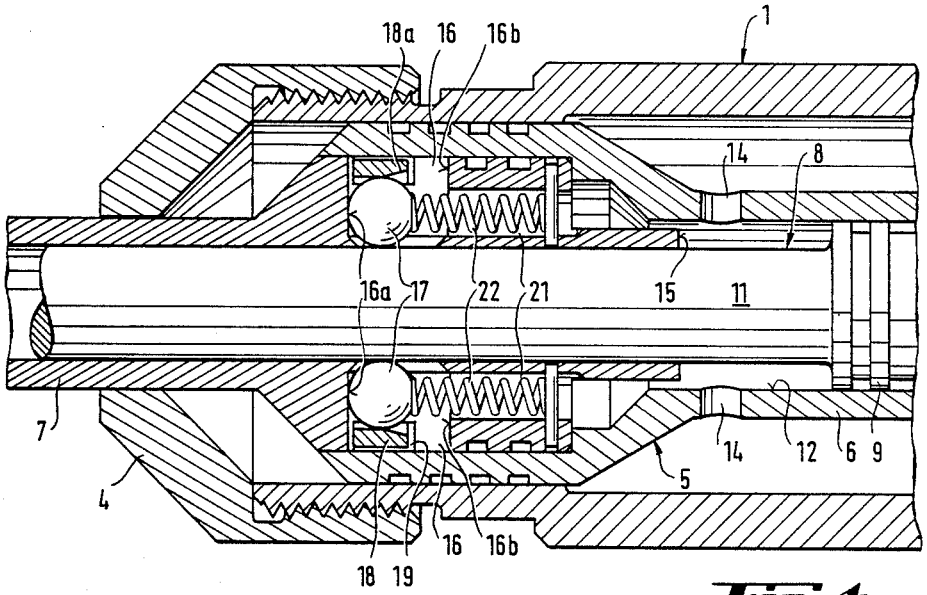
FIG. 4 is a view similar to FIG. 3, however, with the driving piston displaced into the fired position.

In the ready-to-fire position of the setting device, as displayed in FIGS. 1 and 3, the braking balls 17 bear against the surface of the shank 11 in the radial direction without any inward biasing action of the spring 18. When the driving piston moves in the driving direction, the shank 11 moves the braking balls 17 toward the leading end of the device until they contact the leading end surface 16*a* of the recess 16, note FIG. 4. During their movement in the driving direction, the braking balls radially expand the spring 18 by running over the support surface 18*a*. As a result, the spring 18 is tensioned and biases the braking balls against the surface of the shank 11. The spring biasing force causes a braking action on the driving piston as it moves in the driving direction. If the driving piston 8 is displaced from the fired position, as shown in FIG. 4, opposite to the driving direction, the braking balls move opposite to the driving direction at the commencement of the piston displacement and move toward and into contact with the trailing end surface 16*b* of the recess 16, note FIG. 3. As the braking balls 17 move rearwardly, they leave the tensioning region of the spring 18, whereby the braking action acting on the drive piston is eliminated. Driving piston 8 can be brought easily into the ready-to-fire position without experiencing any braking action.

When the driving piston is in the ready-to-fire position, it is possible that it can be displaced slightly in the driving direction prior to firing the explosive powder charge, for instance as a result of jarring the setting device by dropping it on the floor. The spring 18 is tensioned by the braking balls 17 as a result of such displacement. The spring tensioning, however, effects an immediate counteraction moving the driving piston back into the ready-to-fire position due to the contact of the braking balls with the inclined support surface 18*a*.

While specific embodiments of the invention have been shown and described in detail to illustrate the application of the inventive principles, it will be understood that the invention may be embodied otherwise without departing from such principles.

We claim:

1. Explosive powder actuated setting device comprising an axially extending piston guide (5) having a leading end and a trailing end and forming a barrel (12), an axially extending driving piston (8) axially displaceably mounted in said barrel (12), said piston guide (5) having a recess therein opening radially outwardly from said barrel (12), a braking ball (17) located in said recess (16) and in contact with said piston (8), and spring means within said recess for contact with said braking ball, wherein the improvement comprises that said driving piston (8) has a ready-to-fire position and a fired position, said recess (16) has a dimension in the axial direction of said piston guide (5) greater than the diameter of said braking ball, said spring means arranged to bias said braking ball against said piston in the fired position of said piston, said recess has a first end surface extending transversely of the axial direction of said piston and located closer to the leading end of said piston guide and said braking ball contacts said first end surface in the fired position.

2. Explosive powder actuated setting device, as set forth in claim 1, wherein a pair of said recesses (16) are located diametrically opposite one another in said piston guide (5), and one braking ball (17) located in each of said recesses.

3. Explosive powder actuated setting device, as set forth in claim 1, wherein the dimension of said recess (16) in the axial direction of said piston guide (5) is in the range of 1.2 to 2 times the diameter of said braking ball (17).

4. Explosive powder actuated setting device, as set forth in claim 1, wherein said spring means comprises a spring providing a radially directed force pressing said braking ball (17) radially inwardly toward said driving piston (8), said spring has a support surface thereon facing radially inwardly and located closer to the trailing end of said piston guide (5), said support surface is inclined at an acute angle relative to said piston (8) and tapers outwardly in the direction toward the trailing end of said piston guide (5).

5. Setting device, as set forth in claim 4, wherein said spring (18) is a spring ring and the support surface (18) is located in a radially inner surface of said spring ring.

6. Explosive powder actuated setting device, as set forth in claim 5, wherein said spring ring is a split spring ring.

7. Explosive powder actuated setting device, as set forth in claim 1, wherein said piston guide (5) comprises an axially extending trailing part (6) located within said housing, and a leading part (7) located within said housing and extending axially outwardly form the leading end of said housing, said leading part has a radially enlarged axially extending section at the trailing end thereof extending in telescoping fashion into a radially outwardly increased diameter section at the leading end of said trailing part, and said recesses being formed in said enlarged section at the trailing end of said leading part.

* * * * *